US011028511B1

(12) United States Patent
Neill

(10) Patent No.: US 11,028,511 B1
(45) Date of Patent: Jun. 8, 2021

(54) SEWING TEMPLATE DEVICE AND SYSTEM

(71) Applicant: Awesome Things That Work, LLC, Chapel Hill, NC (US)

(72) Inventor: Joseph C. Neill, North Bend, OR (US)

(73) Assignee: Awesome Things That Work, LLC, Chapel Hill, NC (US)

( * ) Notice: Subject to any disclaimer, the term of this patent is extended or adjusted under 35 U.S.C. 154(b) by 0 days.

(21) Appl. No.: 17/163,117

(22) Filed: Jan. 29, 2021

(51) Int. Cl.
*D05B 39/00* (2006.01)

(52) U.S. Cl.
CPC ..... *D05B 39/00* (2013.01)

(58) Field of Classification Search
CPC ..... D05B 19/00; D05B 19/005; D05B 11/00; D05C 9/04; D05C 9/06
USPC ..... 112/117–119, 103
See application file for complete search history.

(56) References Cited

U.S. PATENT DOCUMENTS 2,236,421 A * 3/1941 Boettcher ..... B68G 7/08 112/118
2,410,240 A * 10/1946 Schlicksupp ..... D05B 11/00 112/303
4,192,241 A * 3/1980 Reed ..... D05B 11/00 112/117
5,992,339 A * 11/1999 Mack ..... D05C 9/04 112/103
6,860,211 B2 * 3/2005 Valeriote ..... D05B 11/00 112/117
6,932,007 B1 * 8/2005 Beauchamp ..... D05B 11/00 112/117
6,932,008 B2 * 8/2005 Pfeifer ..... D05B 11/00 112/117
10,760,191 B2 * 9/2020 Takeuchi ..... D05C 5/02
2007/0251111 A1 * 11/2007 Barry ..... D05B 11/00 33/562
2009/0272304 A1 * 11/2009 Watts ..... D05B 11/00 112/118
2011/0079172 A1 * 4/2011 Anderson ..... D05B 11/00 112/117
2014/0150273 A1 * 6/2014 Bland ..... D05B 97/02 33/565
2019/0338450 A1 * 11/2019 Kawaguchi ..... D05C 9/04

* cited by examiner

*Primary Examiner* — Nathan E Durham
(74) *Attorney, Agent, or Firm* — PatentFile, LLC; Bradley C Fach; Steven R. Kick

(57) ABSTRACT

A sewing template system and/or device may include a frame base configured to rest on a workpiece support frame. A first and second extension may each be coupled to a frame base. The first extension and second extension may be separated from each other and parallel to each other. A rail retainer may be coupled to each extension and configured to rest on the workpiece support frame. A frame top may be coupled to the extensions. A frame aperture may be formed by the frame base, first extension, second extension, and frame top. A guide may extend across the frame aperture between the first extension and the second extension, and the guide may be supported above the workpiece by the first extension and the second extension. A template, having guide surface(s) that is configured to guide the movement of a sewing machine foot, may be removably coupled to the guide.

20 Claims, 10 Drawing Sheets

SEWING TEMPLATE DEVICE AND SYSTEM

FIELD OF THE INVENTION

This patent specification relates to the field of devices and systems configured to aid a user in guiding the movement of a sewing machine foot. More specifically, this patent specification relates to a system that is configured to position one or more templates, relative to a sewing workpiece, across which a user may move the foot of a sewing machine thereby guiding the movement of the sewing machine foot.

BACKGROUND

The placing of precise stitches to secure the layers of a quilt and other large workpieces that require sewing by machine have evolved. The use of a workpiece support frame with a Longarm sewing machine integrated inside is a popular option. This may include designs that are followed with a pointer, stylus or laser usually on the back side of the frame. This makes it hard to see where the stitches are on the fabric while monitoring the stylus and patterns. Robotics are used but are expensive. The use of templates on the surface of the quilt that guide the sewing machine foot against the edges are popular. Sometimes this is referred to as ruler work. It involves a platform under the quilt to support the template. The templates often have a non slip surface to reduce the chance for the rulers to move. Templates require some coordination and strength. Since the sewing machine moves under the quilt layers, if a user pushes too hard on the template the sewing machine will not move. Conversely, if a user does not push hard enough the ruler is apt to slip ruining the design. This requires the user to balance the amount of pressure applied while typically holding and moving the templates in awkward positions.

Therefore, a need exists for novel devices and systems configured to aid a user in guiding the movement of a sewing machine foot. A further need exists for novel devices and systems configured to aid a user in guiding the movement of a sewing machine foot that do not require the user to constantly balance the amount of pressure applied to a template.

BRIEF SUMMARY OF THE INVENTION

A sewing template system and device is provided which may be configured to position one or more guide surfaces, relative to a sewing workpiece, across which a user may move the head of a sewing machine thereby guiding the movement of the sewing machine head.

According to one aspect consistent with the principles of the invention, a sewing template system is provided which may be for use with a workpiece support frame that is configured to support a workpiece on a first support rail and a second support rail so that a sewing machine, having a sewing machine foot, is able to sew a portion of the workpiece positioned between the first support rail and second support rail. The system may include a frame base configured to rest on the first support rail. A first extension having a first proximal end and a first distal end, and the first proximal end coupled to the frame base and the first distal end extending away from the frame base. A second extension having a second proximal end and a second distal end, and the second proximal end coupled to the frame base and the second distal end extending away from the frame base. The first extension and second extension may be parallel to each other, and the first extension and second extension may be coupled to the frame base so that the first extension and second extension are separated from each other. A first rail retainer may be coupled to the first distal end and configured to rest on the second support rail, and a second rail retainer may be coupled to the second distal end and configured to rest on the second support rail. A frame top having a first end and a second end, in which the first end is configured to be coupled to the first distal end, and the second end is configured to be coupled to the second distal end. A frame aperture may be formed by the frame base, first extension, second extension, and frame top when the first end is coupled to the first distal end and the second end is coupled to the second distal end. A guide that extends across the frame aperture between the first extension and the second extension, and the guide is supported above the workpiece by the first extension and the second extension.

According to another aspect consistent with the principles of the invention, a sewing template device is provided which may be for use with a workpiece support frame that is configured to support a workpiece on a first support rail and a second support rail so that a sewing machine, having a sewing machine foot, is able to sew a portion of the workpiece positioned between the first support rail and second support rail. The device may include a frame base configured to rest on the first support rail. A first extension having a first proximal end and a first distal end, and the first proximal end coupled to the frame base and the first distal end extending away from the frame base. A second extension having a second proximal end and a second distal end, and the second proximal end coupled to the frame base and the second distal end extending away from the frame base. The first extension and second extension may be parallel to each other, and the first extension and second extension may be coupled to the frame base so that the first extension and second extension are separated from each other. A first rail retainer may be coupled to the first distal end and configured to rest on the second support rail, and a second rail retainer may be coupled to the second distal end and configured to rest on the second support rail. A frame top having a first end and a second end, in which the first end is configured to be coupled to the first distal end, and the second end is configured to be coupled to the second distal end. A frame aperture may be formed by the frame base, first extension, second extension, and frame top when the first end is coupled to the first distal end and the second end is coupled to the second distal end. A guide that extends across the frame aperture between the first extension and the second extension, and the guide is supported above the workpiece by the first extension and the second extension.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

Figure 1:
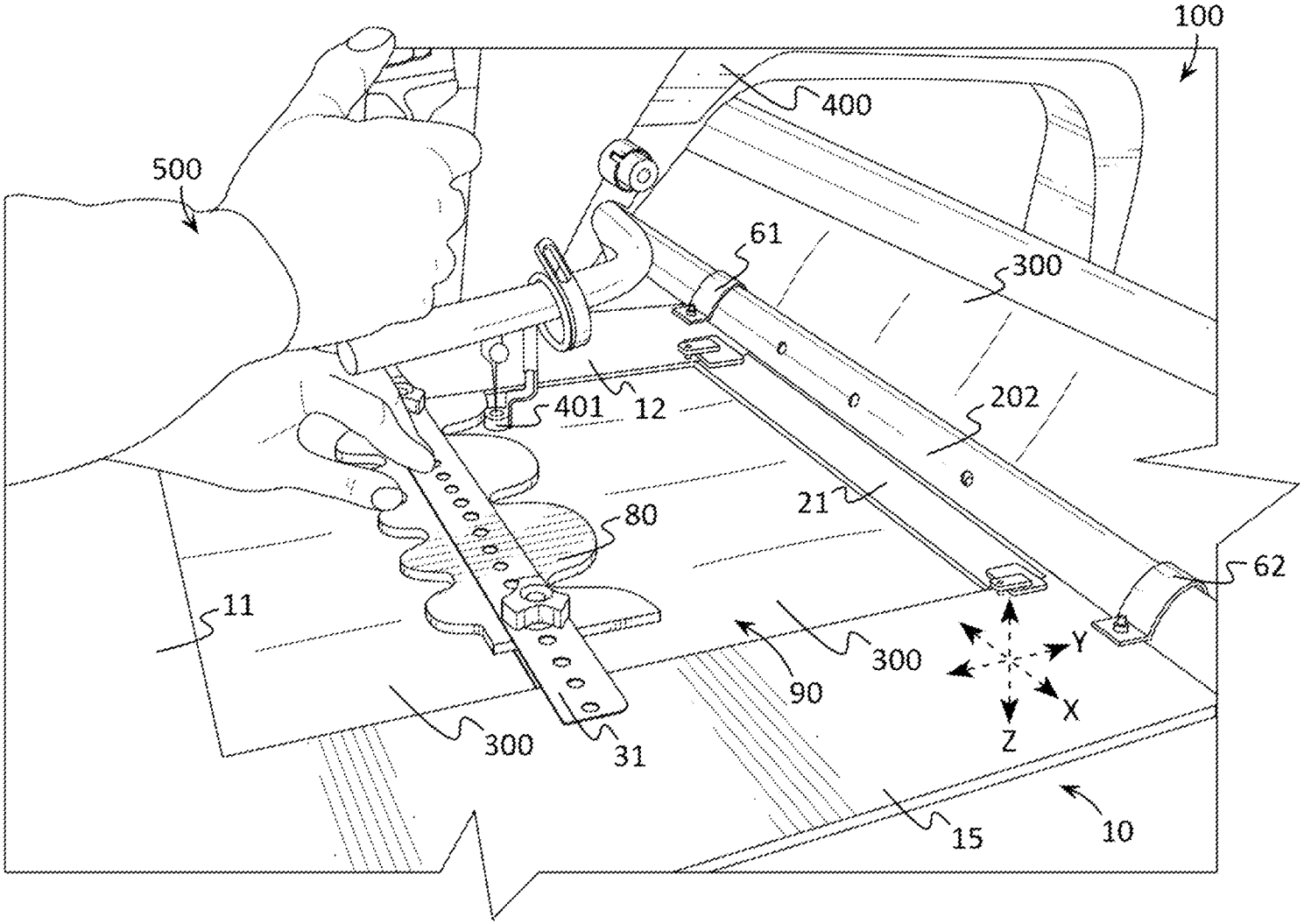
FIG. 1 depicts a perspective view of an example of a sewing template system having a sewing template device being used with a workpiece according to various embodiments described herein.
Figure 2:
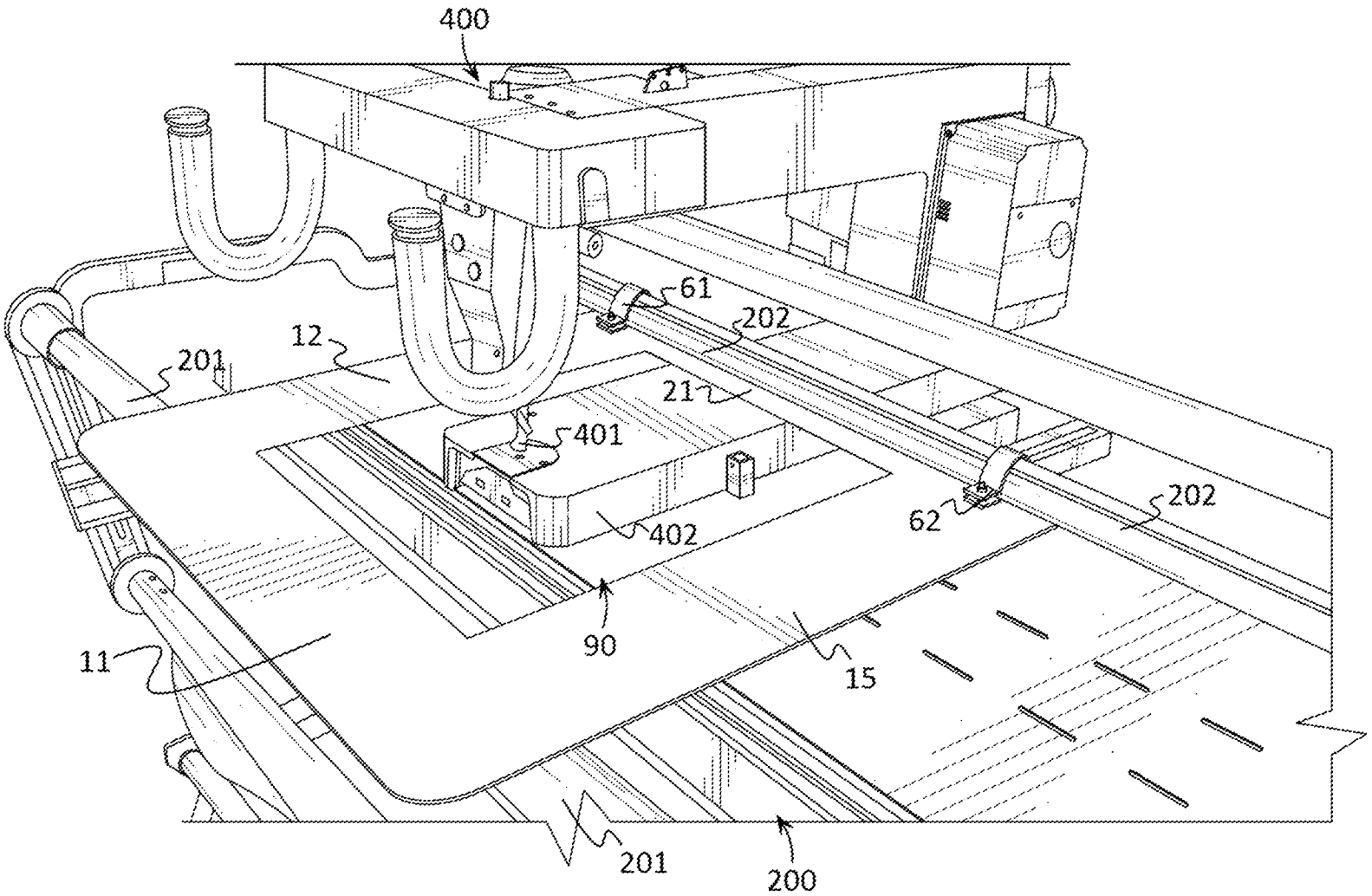
FIG. 2 illustrates a perspective view of an example of a frame base, first extension, second extension, and frame top of a sewing template device being supported on a workpiece support frame, having a first support rail and a second support rail according to various embodiments described herein.

For purposes of description herein, the terms "upper," "lower," "left," "right," "rear," "front," "side," "vertical," "horizontal," and derivatives thereof shall relate to the invention as oriented in FIG. 1. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Although the terms "first," "second," etc. are used herein to describe various elements, these elements should not be limited by these terms. These terms are only used to distinguish one element from another element. For example, the first element may be designated as the second element, and the second element may be likewise designated as the first element without departing from the scope of the invention.

As used in this application, the term "about" or "approximately" refers to a range of values within plus or minus 10% of the specified number. Additionally, as used in this application, the term "substantially" means that the actual value is within about 10% of the actual desired value, particularly within about 5% of the actual desired value and especially within about 1% of the actual desired value of any variable, element or limit set forth herein.

A new sewing template system and device are discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention and is not intended to limit the invention to the specific embodiments illustrated by the figures or description below.

The present invention will now be described by example and through referencing the appended figures representing preferred and alternative embodiments. FIG. 1 illustrates an example of a sewing template system ("the system") 100 according to various embodiments. A sewing template system 100 preferably may be used with a workpiece support frame 200 that is configured to support a workpiece 300 on a first support rail 201 and a second support rail 202 so that a sewing machine 400, having a sewing machine foot 401, is able to sew a portion of the workpiece 300 positioned between the first support rail 201 and second support rail 202. Generally, a workpiece support frame 200 may comprise a first support rail 201, that may be positioned relatively closer to a user 500, and a second support rail 202, that may be positioned relatively farther from the user 500. A workpiece 300 is typically draped over the first support rail 201 and under the second support rail 202 so that the portion of the workpiece 300 that is between the rails 201, 202, may be supported or suspended by the rails 201, 202. A sewing machine 400 having a sewing machine foot 401 may be positioned so that the sewing machine foot 401 is in contact with the portion of the workpiece 300 that is between the rails 201, 202. The sewing machine base 402 is positioned below the sewing machine foot 401 on the opposite side of the workpiece 300 so that the sewing machine foot 401 and sewing machine base 402 may interact to sew or apply stitching to the workpiece 300.

In some embodiments, the system 100 may comprise a sewing template device ("the device") 10 that may include a frame base 11 that may be configured to rest on the first support rail 201. A first extension 12 and a second extension 15 may be coupled to the frame base 11. The first extension 12 may have a first proximal end 13 and a first distal end 14, and the first proximal end 13 may be coupled to the frame base 11 and the first distal end 14 may extend away from the frame base 11. The second extension 15 may have a second proximal end 16 and a second distal end 17, and the second proximal end 16 may be coupled to the frame base 11 and the second distal end 17 may also extend away from the frame base 11 in a direction generally parallel to the first distal end 14 so that the first extension 12 and second extension 15 may be parallel or substantially parallel (plus or minus 5 degrees) to each other. A first rail retainer 61 may be coupled to the first distal end 14 and configured to rest on the second support rail 202, and a second rail retainer 62 may be coupled to the second distal end 17 and configured to rest on the second support rail 202. A frame top 21, having a first end 22 and a second end 23, may be coupled to the distal ends 14, 17, with the first end 22 configured to be coupled to the first distal end 14, and the second end 23 configured to be coupled to the second distal end 17. A frame aperture 90 may be formed by the frame base 11, first extension 12, second extension 15, and frame top 21 when the first end 22 is coupled to the first distal end 14 and the second end 23 is coupled to the second distal end 17. A guide 31 may extend across the frame aperture 90 between the first extension 12 and the second extension 15 so that the guide 31 is able to be supported above the workpiece 300 by the first extension 12 and the second extension 15.

The device 10 may comprise a frame base 11 which may be used to couple the first extension 12 and second extension 15 together while allowing the extensions 12, 15, to be separated from each other. Preferably, a frame base 11 may be generally flat planar in shape, such as by being formed of ¼ inch thick Polycarbonate and Acrylic plastic sheet material. More, preferably, a frame base 11 may be made from or may comprise a generally clear or transparent material, such as clear Polycarbonate and Acrylic plastic sheet material which may be sold under the trade names of LEXAN™ and Plexiglass™. However, a frame base 11 may be configured in any shape and any size and may be made from or may comprise any substantially rigid material, such as other plastics, aluminum or other metals, etc.

A frame base 11 may comprise a base upper surface 51 and an opposing base lower surface 52. Preferably, all or portions of the base upper surface 51 and base lower surface 52 may be generally flat or planar in shape. Generally, a base lower surface 52 may rest on or otherwise be supported by a first support rail 201. For example, a base lower surface 52 may rest directly on a first support rail 201 or indirectly on a first support rail 201 by resting on a portion of a workpiece 300 that is resting on or draped over the first support rail 201.

In some embodiments, a frame base 11 may comprise one or more non-slip pads 63 which may be coupled to the base upper surface 51 and/or base lower surface 52. Preferably, a frame base 11 may comprise one or more non-slip pads 63 which may be coupled to the frame bottom surface 11B and positioned to contact the first support rail 201 or a portion of a workpiece 300 that is resting on or draped over the first support rail 201.

A non-slip pad 63 may be made from and/or may comprise a resilient material which when placed into contact with another material may contribute to a relatively high friction of coefficient between the resilient material and the other material. Preferably, a resilient material may be a natural and/or synthetic material, which is flexible to allow slight deformation and resilient so as to return to its original shape after deformation. Example resilient materials include latex rubber, silicone rubber, forms of the organic compound isoprene, such as polyisoprene, Butyl rubber, Polyacrylate Rubber, Ethylene-acrylate Rubber, Polyester Urethane, Bromo Isobutylene Isoprene, Polybutadiene, Chloro Isobutylene Isoprene, Polychloroprene, Chlorosulphonated Polyethylene, Epichlorohydrin, Ethylene Propylene, Ethylene Propylene Diene Monomer, Polyether Urethane, Perfluorocarbon Rubber, Fluoronated Hydrocarbon, Fluoro Silicone, Fluorocarbon Rubber, Hydrogenated Nitrile Butadiene, Polyisoprene, Isobutylene Isoprene Butyl, Acrylonitrile Butadiene, Polyurethane, Styrene Butadiene, Styrene Ethylene Butylene Styrene Copolymer, Polysiloxane, Vinyl Methyl Silicone, Acrylonitrile Butadiene Carboxy Monomer, Styrene Butadiene Carboxy Monomer, Thermoplastic Polyether-ester, Styrene Butadiene Block Copolymer, and Styrene Butadiene Carboxy Block Copolymer. In further embodiments, a non-slip pad 63 may be made from and/or may comprise any material which when placed into contact with another material may contribute to a friction of coefficient greater than 0.3, and more preferably greater than 0.5, between the material of the non-slip pad 63 and the other material.

The device 10 may comprise one or more extensions, such as a first extension 12 and a second extension 15, which may each be coupled to the frame base 11 and to a frame top 21. Generally, extensions 12, 15, may be used to couple the frame base 11 and frame top 21 together while allowing the frame base 11 and frame top 21 to be separated from each other so that portions of a frame aperture 90 may be formed between the frame base 11 and frame top 21 and the extensions 12, 15. Preferably, an extension 12, 15, may be generally flat planar in shape, such as by being formed of ¼ inch thick Polycarbonate and Acrylic plastic sheet material. More preferably, an extension 12, 15, may be made from or may comprise a generally clear or transparent material, such as clear Polycarbonate and Acrylic plastic sheet material which may be sold under the trade names of LEXAN™ and Plexiglass™. However, an extension 12, 15, may be made from or may comprise any substantially rigid material, such as other plastics, aluminum or other metals, etc.

A first extension 12 may comprise a first extension upper surface 55 and an opposing first extension lower surface 56. Preferably, all or portions of the first extension upper surface 55 and first extension lower surface 56 may be generally flat or planar in shape. Likewise, a second extension 15 may comprise a second extension upper surface 57 and an opposing second extension lower surface 58. Preferably, all or portions of the second extension upper surface 57 and second extension lower surface 58 may be generally flat or planar in shape.

Frame extensions 12, 15, may be configured in any shape and size. Generally, the longer an extension 12, 15, is, the greater the distance a frame 21 may be positioned away from a frame base 11. In preferred embodiments, the device 10 may comprise a first extension 12 and a second extension 15 which may be generally elongated and rectangular in shape and which may be coupled to the frame base 11 so that the distal ends 14, 17, may extend away from the frame base 11 in a direction generally parallel to each other. For example, the extensions 12, 15, may be generally elongated and rectangular in shape and may be coupled to the frame base 11 and frame top 21 in a generally perpendicular manner. In other embodiments, the device 10 may comprise two or more extensions 12, 15, which may be angled relative to the frame base 11 and frame top 21. For example, the distal ends 14, 17, of the extensions 12, 15, may be relatively closer together proximate to the frame top 21 or relatively closer together proximate to the frame base 11.

In some embodiments, the device 10 may comprise one or more rail retainers, such as a first rail retainer 61 and a second rail retainer 62, which may be configured to rest on an extension 12, 15, frame top 21, or other element to a workpiece support frame 200. In preferred embodiments, rail retainer 61, 62, may be configured to rest on and secure or otherwise removably couple an extension 12, 15, frame top 21, and/or other element to a workpiece support frame 200. In preferred embodiments, a first rail retainer 61 may be coupled to the distal end 14 of a first extension 12, and a second rail retainer 62 may be coupled to the distal end 17 of a second extension 15 with the rail retainers 61, 62, configured to secure or otherwise couple each extension 12, 15, to a second support rail 201 of workpiece support frame 200.

A rail retainer 61, 62, may comprise any suitable coupling device or method. Preferably, a rail retainer 61, 62, may be configured to rest on secure and secure or otherwise removably couple an extension 12, 15, to a generally cylindrically shaped second support rail 202 by having a retainer surface 61A, 62A, formed by the rail retainer 61, 62, that is concave in shape so that the retainer surface 61A, 62A, is configured to wrap around convex portions of the cylindrically shaped second support rail 202. For example, a first rail retainer 61 may have a first retainer surface 61A having a concave shape and a second rail retainer 62 may have a second retainer surface 62A having a concave shape, and the retainer surfaces 61A, 62A, may enable the rail retainers 61, 62, (and therefore the device 10) to slide right and left along the rail 201 the cylindrically shaped second support rail 202 while generally preventing the frame base 11 from moving towards and away from the second support rail 202. This may enable a user 500 to easily move the device 10 to desired portions of a workpiece 300 that is supported by the support rails 201, 202, that the device 10 is resting on.

The device 10 may comprise a frame top 21 that may be configured to be coupled to a first extension 12 and a second extension 15. Preferably, a frame top 21 may be generally flat planar in shape, such as by being formed of ¼ inch thick Polycarbonate and Acrylic plastic sheet material. More preferably, a frame top 21 may be made from or may comprise a generally clear or transparent material, such as clear Polycarbonate and Acrylic plastic sheet material which may be sold under the trade names of LEXAN™ and Plexiglass™. However, a frame top 21 may be made from or may comprise any substantially rigid material, such as other plastics, aluminum or other metals, etc.

A frame top 21 may comprise a top upper surface 53 and an opposing top lower surface 54. Preferably, all or portions of the top upper surface 53 and top lower surface 54 may be generally flat or planar in shape. Generally, the upper surfaces 51, 53, 55, 57, may all be facing away from a workpiece 300 that the device 10 is positioned over while the lower surfaces 52, 54, 56, 58, may be facing or oriented towards the workpiece 300.

A frame top 21 may be configured in any shape any size. Generally, the longer a frame top 21 is, the greater the distance a first distal end 14 of a first extension 12 may be positioned away from a second distal end 17 of a second extension 15. In some embodiments, a frame top 21 may have a first end 22 and a second end 23, and the first end 22 may be configured to be coupled to the first distal end 14 of a first extension 12 and the second end 23 may be configured to be coupled to the second distal end 17 of a second extension 15. In further embodiments, one end 22, 23, of a frame top 21 may be movably coupled to the other distal end 14, 17, while the other end 22, 23, of a frame top 21 may be removably coupled to the other distal end 14, 17.

In preferred embodiments, a first end 22 may be configured to be removably coupled to the first distal end 14 of a first extension 12 and/or the second end 23 may be configured to be removably coupled to the second distal end 17 of a second extension 15.

In further preferred embodiments, the device 10 may comprise one or more male protrusions 64 and female indentions 65 which may be used to removably couple one or more ends 22, 23, of a frame top 21 to one or more extensions 12, 15. Optionally, the first end 22 of the frame top 21 may comprise a first male protrusion 64 and the first distal end 14 may comprise a first female indention 65 that is complementary in shape to the first male protrusion 64, and the first male protrusion 64 may be received in the female indention 65 when the first end 22 is coupled to the first distal end 14. Likewise, the second end 23 of the frame top 21 may comprise a second male protrusion 64 and the second distal end 17 may comprise a second female indention 65 that is complementary in shape to the second male protrusion 64, and the second male protrusion 64 may be received in the second female indention 65 when the second end 23 is coupled to the second distal end 17.

Figure 3:
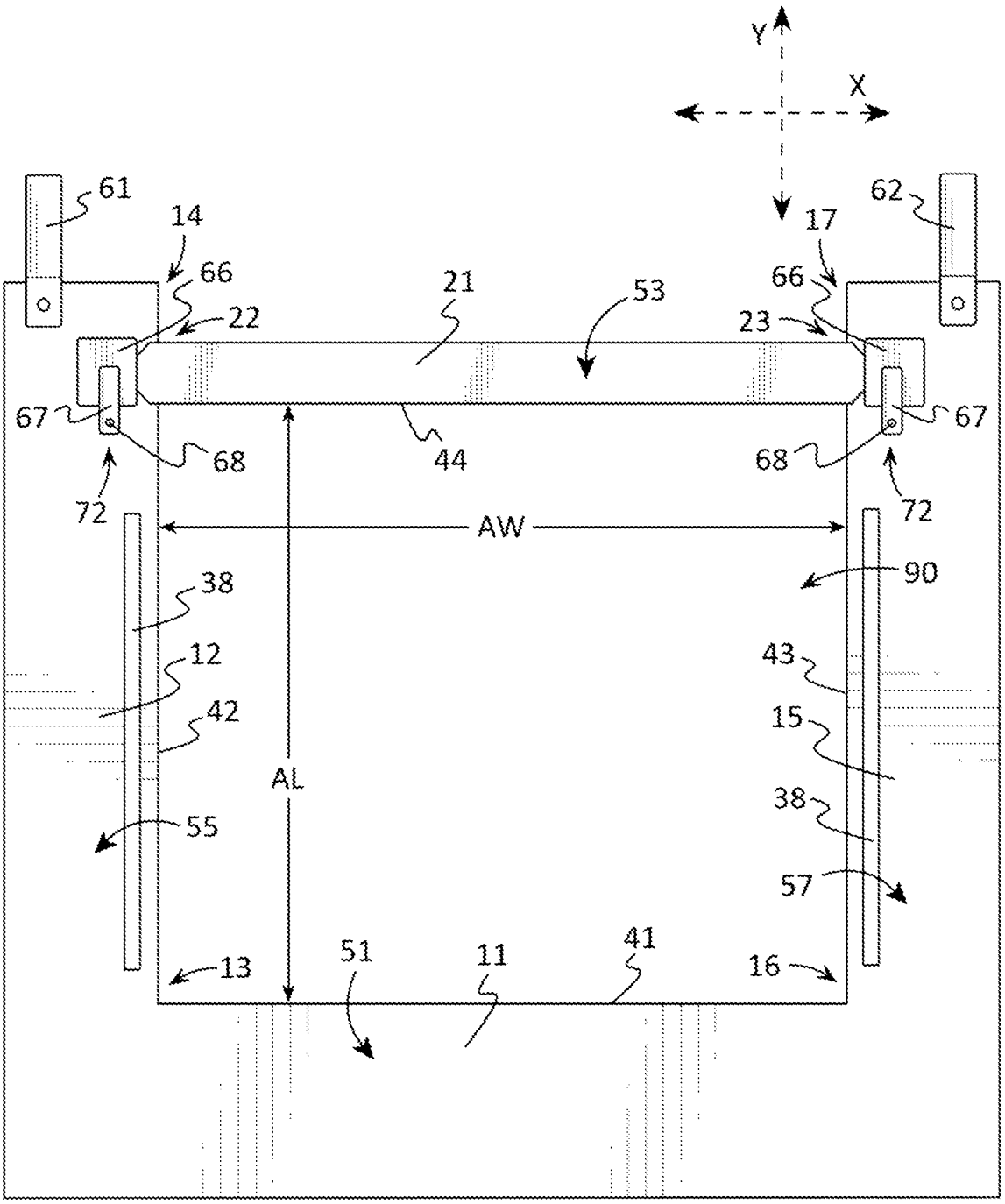
FIG. 3 shows a top plan view of an example of a frame base, first extension, second extension, and frame top of a sewing template device according to various embodiments described herein.
Figure 4:
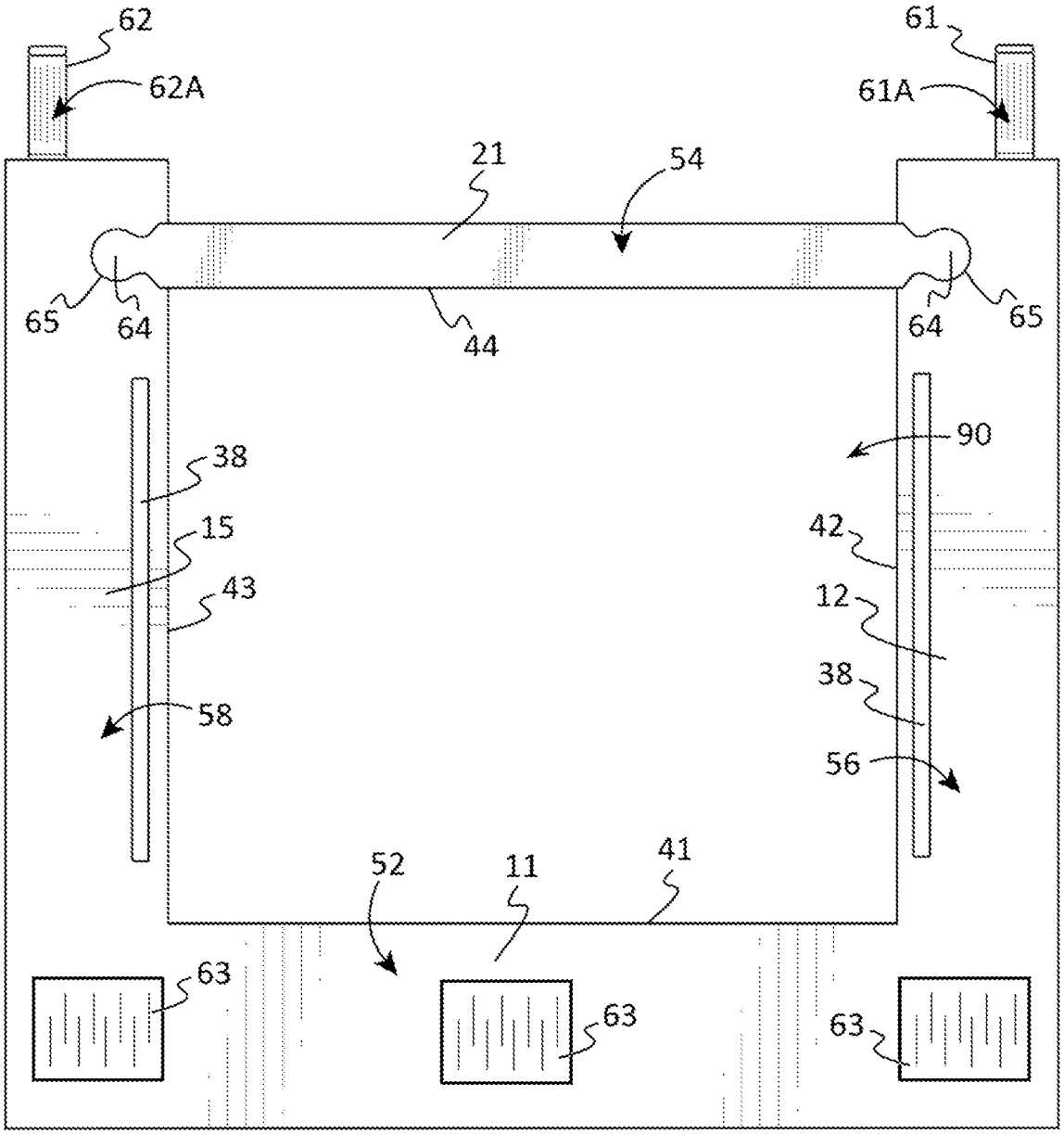
FIG. 4 depicts a bottom plan view of an example of a frame base, first extension, second extension, and frame top of a sewing template device according to various embodiments described herein.
Figure 5A:
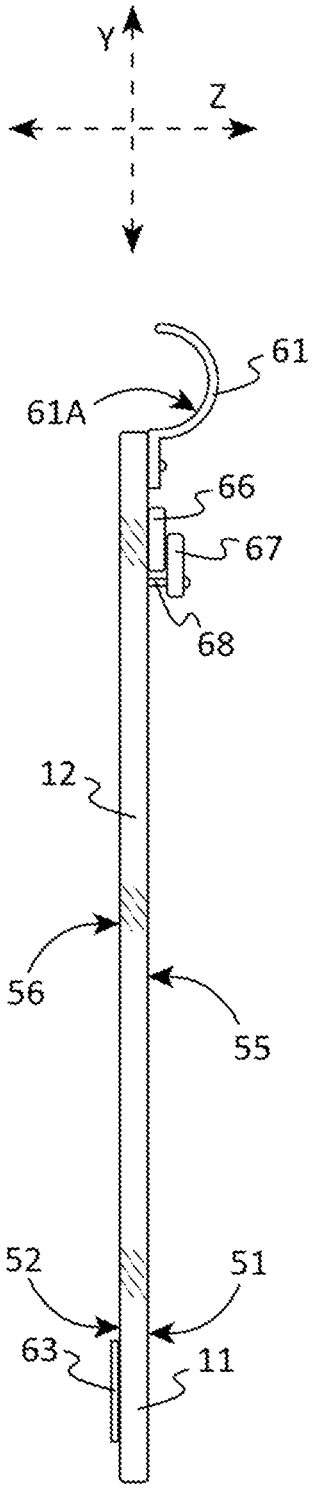
FIG. 5A illustrates a first side view of some example elements of sewing template device according to various embodiments described herein.
Figure 5B:
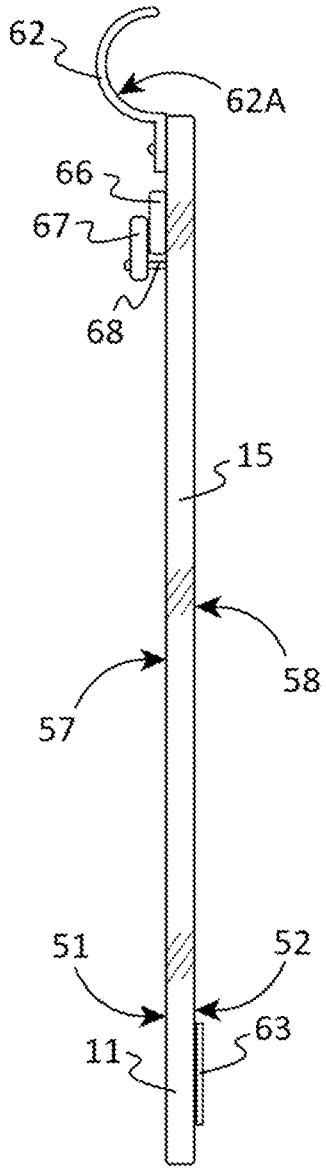
FIG. 5B depicts a second side view of some example elements of sewing template device according to various embodiments described herein.

Generally, a male protrusion 64 may be received or inserted into a female indention 65, and the male protrusion 64 may be slightly smaller and complementary in shape to the female indention 65 that is configured to receive the male protrusion 64. For example, a female indention 65 may comprise a generally rounded shaped indentation or depression in an extension 12, 15, and a male protrusion 64 may comprise a generally rounded shaped protrusion in a frame top 21 and the female indention 65 and male protrusion 64 may interlock similar to two complementary shaped puzzle pieces that are mated or joined together. As another example, a female indention 65 may comprise a generally rounded shaped indentation or depression in a frame top 21 and a male protrusion 64 may comprise a generally rounded shaped protrusion in an extension 12, 15, and the female indention 65 and male protrusion 64 may interlock similar to two complementary shaped puzzle pieces that are mated or joined together. In this manner, the male protrusion 64 may be configured to preferably tightly or snuggly fit into the female indention 65 so that movement of the male protrusion 64 in the female indention 65 may be substantially prevented. As a further example, the device 10 (and therefore the system 100) may comprise an x-axis, a y-axis, and a z-axis as shown in FIGS. 1, 3, and 5A, and a male protrusion 64 may be prevented or substantially prevented (movement of less than 2 millimeters) from moving in the x-axis (direction towards and away from the first extension 12, second extension 15, etc.) and y-axis (direction towards and away from the frame base 11, frame top 21, support rails 201, 202, etc.) when it is received in the female indention 65, and the male protrusion 64 may be released from the female indention 65 by moving the male protrusion 64 in the z-axis (up and down directions).

In some embodiments, the device 10 may comprise one or more stop plates 66 which may be configured to limit the ability of a male protrusion 64 to be moved in one direction in the z-axis when the male protrusion 64 is received and being positioned in a female indention 65. A stop plate 66 may be configured in any shape and size. In preferred embodiments, a stop plate 66 may be coupled to one side of a male protrusion 64 and the stop plate 66 may be configured with a size and shape that is larger than the male protrusion 64 and female indention 65. The side of the male protrusion 64 that is not coupled to the stop plate 66 may then be inserted into the female indention 65 (such as in the down direction of the z-axis) while the stop plate 66 prevents the male protrusion 64 from passing or falling through female indention 65. Preferably, a stop plate 66 may be coupled to each male protrusion 64.

Figure 6:
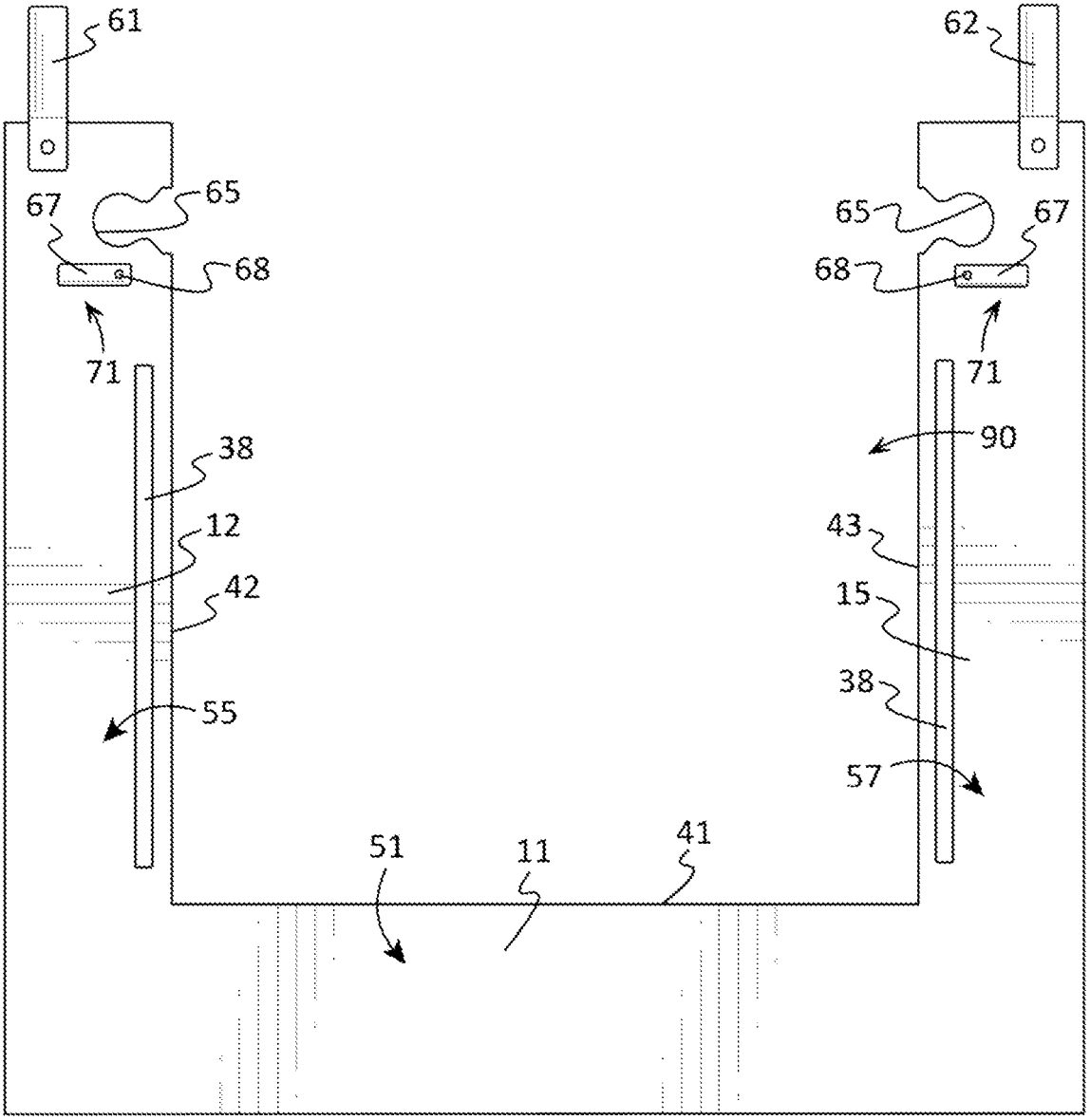
FIG. 6 shows a top plan view of an example of a frame base, first extension, and second extension of a sewing template device according to various embodiments described herein.
Figure 7A:
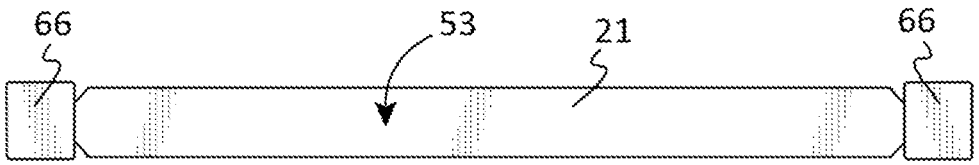
FIG. 7A depicts a top plan view of an example of a frame top according to various embodiments described herein.
Figure 7B:
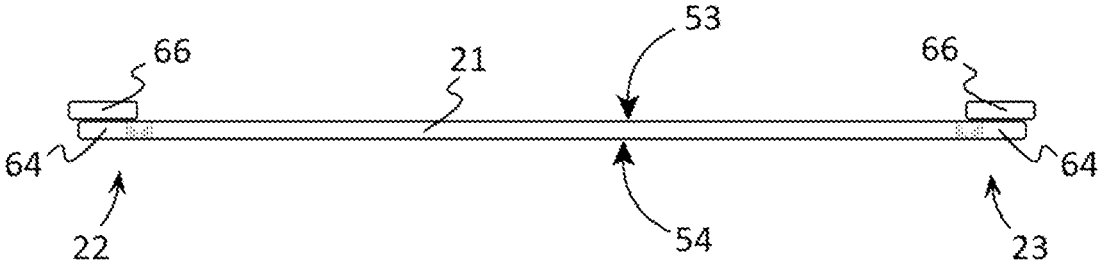
FIG. 7B illustrates a side elevation view of an example of a frame top according to various embodiments described herein.
Figure 7C:
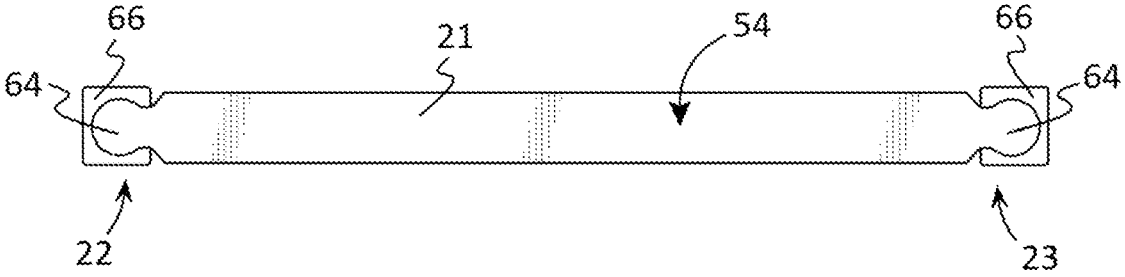
FIG. 7C shows a bottom plan view of an example of a frame top according to various embodiments described herein.

In some embodiments, the device 10 may comprise one or more plate locks 67 which along with a stop plate 66 may be configured to block movement of a male protrusion 64 to be moved in the z-axis when the male protrusion 64 is received and being positioned in a female indention 65. Generally, a plate lock 67 may block movement of a male protrusion 64 in the z-axis in a direction that is opposite to the direction that a stop plate 66 is preventing movement of the plate lock 67. In this manner a plate lock 67 and stop plate 66 may govern the ability of a protrusion 64 to be moved in the z-axis into and out of a female indention 65. In preferred embodiments, a stop plate 67 may be movably coupled to an element of the device 10, such as to an extension 12, 15, so that the stop plate 67 is movably between an open position 71 (FIG. 6), in which the plate lock 67 is not positioned over a stop plate 66 that is coupled to a male protrusion 64 when the male protrusion 64 is positioned in a female indention 65, and a closed position 72 (FIG. 3), in which the plate lock 67 is positioned over a stop plate 66 that is coupled to a male protrusion 64 when the male protrusion 64 positioned in a female indention 65. In the open position 71, the plate lock 67 may not interfere with the ability of the male protrusion 64 is positioned in and out of a female indention 65, while in the closed position 72 so that it is placed over the stop plate 66, the plate lock 67 may block the ability of stop plate 66, and therefore the male protrusion 64, to be removed out of a female indention 65 that the male protrusion 64 is positioned in. Any suitable movable coupling may be used to movably couple a plate lock 67 to an extension 12, 15, or other element of the device 10, such as a pivot pin 68, hinge, tongue-and-groove slide lock, turn lock, etc.

The device 10 may comprise a frame aperture 90 which may be formed by the frame base 11, first extension 12, second extension 15, and frame top 21. A frame base 11 may comprise a base interior perimeter 41; a first extension 12 may comprise a first extension interior perimeter 42; a second extension 15 may comprise a second extension interior perimeter 43; and frame top 21 may comprise a top interior perimeter 44. The interior perimeters 41, 42, 43, 44, may form and bound the frame aperture 90. The interior perimeters 41, 42, 43, 44, may be configured in any size and shape to form a frame aperture 90 of any size and shape. Preferably, the frame aperture 90 may be generally rectangular in shape with the two extension perimeters 42, 43, being approximately linear or straight and parallel to each other while each being approximately coupled to the base 41 and top 42 interior perimeters in an approximately perpendicular manner with the base 41 and top 42 interior perimeters being straight and parallel to each other. In other embodiments, one or more interior perimeters 41, 42, 43, 44, may be angled, curved, comprise a series of indexing notches, or comprise any other shape.

While a frame aperture 90 may be configured in any shape and size, in preferred embodiments, a frame aperture 90 may comprise an aperture width dimension (AW) and an aperture length dimension (AL) as shown in FIG. 3. An aperture width dimension (AW) may describe the largest distance between two extension perimeters 42, 43, while an aperture length dimension (AL) may describe the largest distance between the base 41 and top 42 interior perimeters. As an example, for extension perimeters 42, 43, that are generally parallel, the AW may be approximately consistent or uniform along the lengths of the extension perimeters 42, 43.

In some embodiments, the AL of a frame aperture 90 may be between approximately 200 millimeters and 1 meter, more preferably, between approximately 400 millimeters and 600 millimeters, and even more preferably, approximately 460 millimeters. However, in other embodiments, the AL of a frame aperture 90 may be configured in any other length. In some embodiments, the AW of a frame aperture 90 may be between approximately 200 millimeters and 1 meter, more preferably, between approximately 400 millimeters and 600 millimeters, and even more preferably, approximately 460 millimeters. However, in other embodiments, the AW of a frame aperture 90 may be configured in any other length.

In some embodiments, the device 10 may comprise a guide 31 that is configured to extend across a frame aperture 90, and one or more templates 80 and/or a sewing machine foot 401 may be placed into contact with the guide 31 and/or templates 80 so that a user 500 may guide the movement of the sewing machine foot 401 by moving the sewing machine foot 401 across surfaces of the guide 31 and/or templates 80. A guide 31 may be configured in any shape and size.

In some embodiments, a guide 31 may comprise a top brace 32, and the top brace 32 may be configured to extend across the frame aperture 90 and rest on both the first extension 12 and the second extension 15 so that the guide 31 is supported by the first extension 12 and the second extension 15. The guide 31 may comprise a guide length dimension (GL) that may describe the length of the guide 31 as shown in FIG. 8B. In preferred embodiments, the length of the top brace 32 may form the guide length dimension (GL) so that the top brace 32 may form the longest element of the guide 31.

In preferred embodiments, the GL may be greater than the AW of the frame aperture 90 so that the guide 31 may extend across the frame aperture 90 and rest on both the first extension 12 and second extension 15 so that the guide 31 is supported by the first extension upper surface 55 of the first extension 12 and the second extension upper surface 57 of the second extension 15. In further embodiments, the GL may be greater than the AL of the frame aperture 90 so that the guide 31 may extend across the frame aperture 90 and rest on both the base upper surface 51 of the frame base 11 and top upper surface 53 of the frame top 21 so that the guide 31 is supported by the frame base 11 and frame top 21.

A top brace 32 may be configured in any shape and size. In preferred embodiments, a top brace 32 may be generally rectangular in shape, such as by being made from a sheet of rectangular metal, plastic, etc. Optionally, a top brace 32 may comprise one or more top brace apertures 33 of any size and shape, such as circular.

In some embodiments, a guide 31 may comprise a bottom brace 34 which may be coupled to a top brace 32. A bottom brace 34 may be configured in any size and shape. In some embodiments, a bottom brace 34 may be smaller in length than the AW and/or AL of a frame aperture 90. In further embodiments, a bottom brace 34 may be approximately equal in length dimension to the top brace 32. In still further embodiments, the bottom brace 34 may be larger in length than the top brace 32 so that the length of the bottom brace 34 forms the GL.

A bottom brace 34 may be configured in any shape and size. In preferred embodiments, a bottom brace 34 may be generally rectangular in shape, such as by being made from a sheet of rectangular metal, plastic, etc. Optionally, a bottom brace 34 may comprise one or more bottom brace apertures 35 of any size and shape, such as circular.

In some embodiments, a guide 31 may comprise one or more tensioners 36 which may be configured to couple the bottom brace 34 and the top brace 32 together. In preferred embodiments, a guide 31 may comprise one or more tensioners 36 which may be configured to couple the bottom brace 34 and the top brace 32 together by tensioning the bottom brace 34 towards the top brace 32. For example, a tensioner 36 may comprise thumb knob having threading 37 which may be used to threadedly engage a bottom brace 34 and the top brace 32 together such that by turning the tensioner 36 in a first direction the bottom brace 34 and the top brace 32 may be increasingly tensioned together and by turning the tensioner 36 in a second direction the tension between the bottom brace 34 and the top brace 32 may be decreased so as to allow the bottom brace 34 and the top brace 32 to be increasingly separated from each other even up to being uncoupled from each other. Other example tensioners 36 may include wingnuts, bolts, nuts, screws, other threaded fasteners, or any other device or fastening method which may be used to tension a bottom brace 34 and the top brace 32 together.

In some embodiments, a guide 31 may be movably and removably coupled to one or more other elements of the device 10 (such as a frame base 11, first extension 12, second extension 15, and/or frame top 21) by positioning portions of the one or more elements between the top brace 32 and the bottom brace 34 and then tensioning the braces 32, 34, together so that the one or more elements are positioned and/or optionally tensioned between the braces 32, 34.

In some embodiments, a guide 31 may comprise one or more non-slip pads 63 which may be used to control the amount of friction between the guide 31 and portions of the frame base 11, first extension 12, second extension 15, and/or frame top 21 that the guide 31 may be in contact with. One or more non-slip pads 63 may be coupled to a top brace 32 and/or the bottom brace 34 and positioned so that the non-slip pads 63 may contact portions of the frame base 11, first extension 12, second extension 15, and/or frame top 21 that the guide 31 may be in contact with thereby increasing the coefficient of friction between the guide 31 and one or more of the frame base 11, first extension 12, second extension 15, and/or frame top 21. In this manner, non-slip pads 63 may help the user 500 control the movement of the guide 31 across the portions of the frame base 11, first extension 12, second extension 15, and/or frame top 21 that the guide 31 may be in contact with. In further embodiments, one or more non-slip pads 63 may be coupled to a top brace 32 and/or the bottom brace 34 and positioned so that the non-slip pads 63 are between the braces 32, 34, when the braces 32, 34, are coupled together. This may allow those non-slip pads 63 to grip portions of a template 80, frame base 11, first extension 12, second extension 15, and/or frame top 21 which may be positioned between the braces 32, 34.

In some embodiments, the device 10 may comprise one or more templates 80, such as a first template 80A (FIGS. 8A-8C), a second template 80B (FIGS. 9A and 9B), etc. which may be placed into contact with a guide 31 and which may be used by a user 500 to guide the movement of a sewing machine foot 401 by moving the sewing machine foot 401 across surfaces of the templates 80. A template 80 may be configured in any shape and size. Generally, a template 80 may comprise one or more guide surfaces 81, 82, 83, which may be shaped and contoured to allow a sewing machine foot 401 to easily move across the guide surfaces 81 so that the sewing machine 400 may create desired patterns on a workpiece 300 that is supported between a first support rail 201 and second support rail 202 on a workpiece support frame 200.

In preferred embodiments, a template 80 may comprise a first guide surface 81, a second guide surface 82, a third guide surface 83, etc. The guide surfaces 81, 82, 83, may be distinguished from each other in that the guide surfaces 81, 82, 83, do not meet each other. Guide surfaces 81, 82, 83, may be configured in any size and shape. Guide surfaces 81, 82, 83, with the suffixes of "A" and "B" simply designate different embodiments of the guide surfaces 81, 82, 83, so that guide surfaces 81A, 81B, 82A, 82B, 83A, 83B, read on the teachings of guide surfaces 81, 82, 83).

Figure 8A:
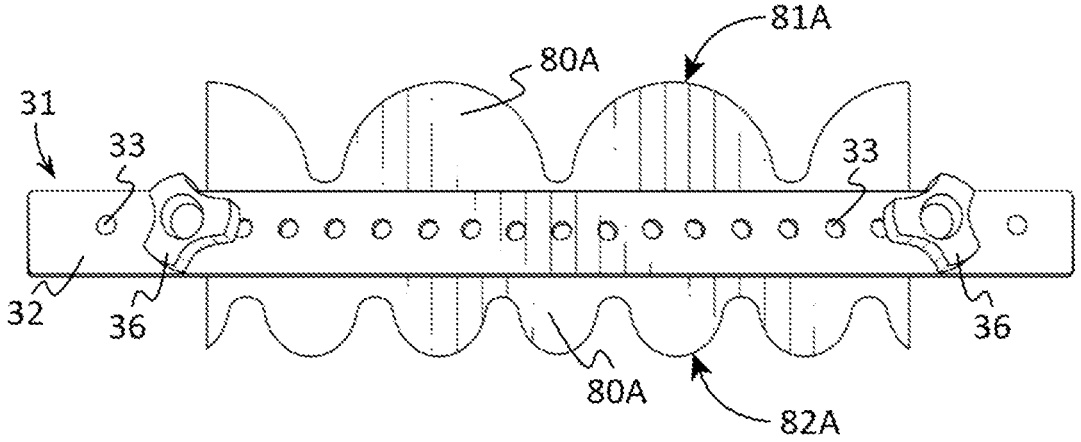
FIG. 8A depicts a top plan view of an example of a guide and a template according to various embodiments described herein.
Figure 8B:
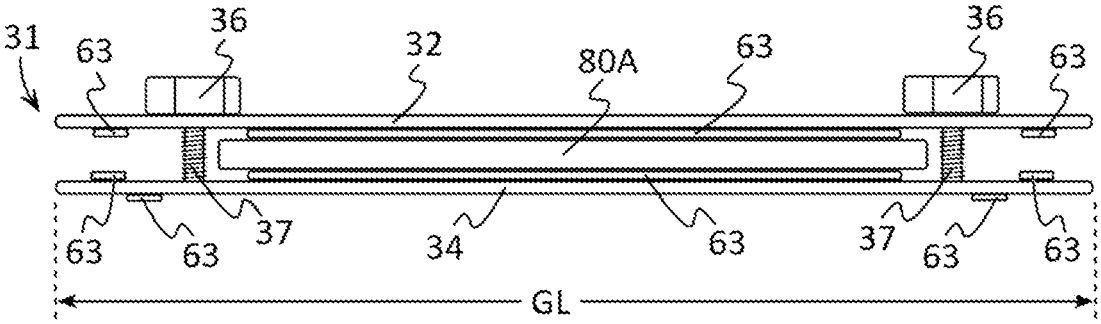
FIG. 8B illustrates a side elevation view of an example of a guide and a template according to various embodiments described herein.
Figure 8C:
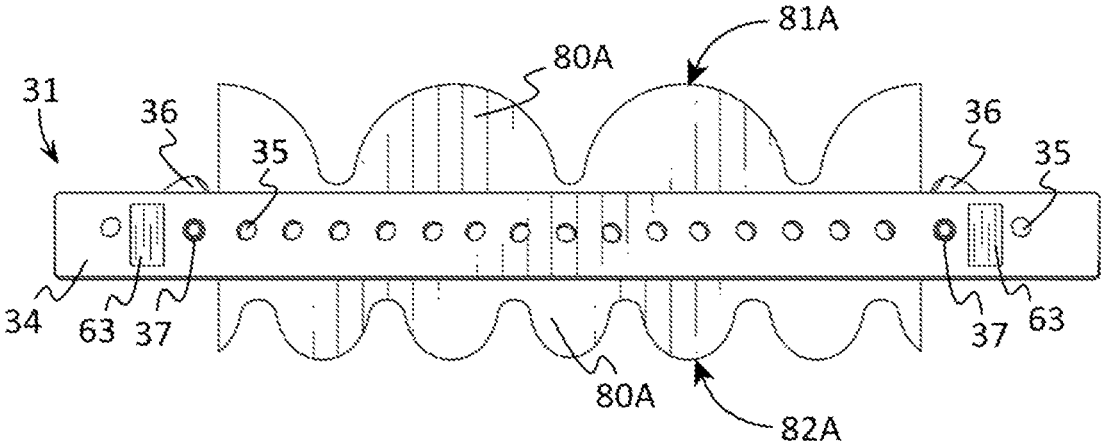
FIG. 8C shows a bottom plan view of an example of a guide and a template according to various embodiments described herein.

Referring to the example template 80A of FIGS. 8A-8C, the template 80A may comprise a first guide surface 81A and a second guide surface 82A which may be shaped differently than each other. In this example, the first guide surface 81A comprises a series of alternating arcs and the second guide surface 82A also comprises a series of alternating arcs while the first guide surface 81A comprises a number of arcs that are relatively larger than the arcs of the second guide surface 82A. In this manner, when a user 500 moves a sewing machine foot 401 across or along the first guide surface 81A the sewing machine 400 may produce stitching with a scallop or wave pattern that has relatively larger arcs than the scallop or wave that may be produced by moving the sewing machine foot 401 across or along the second guide surface 82A.

Figure 9A:
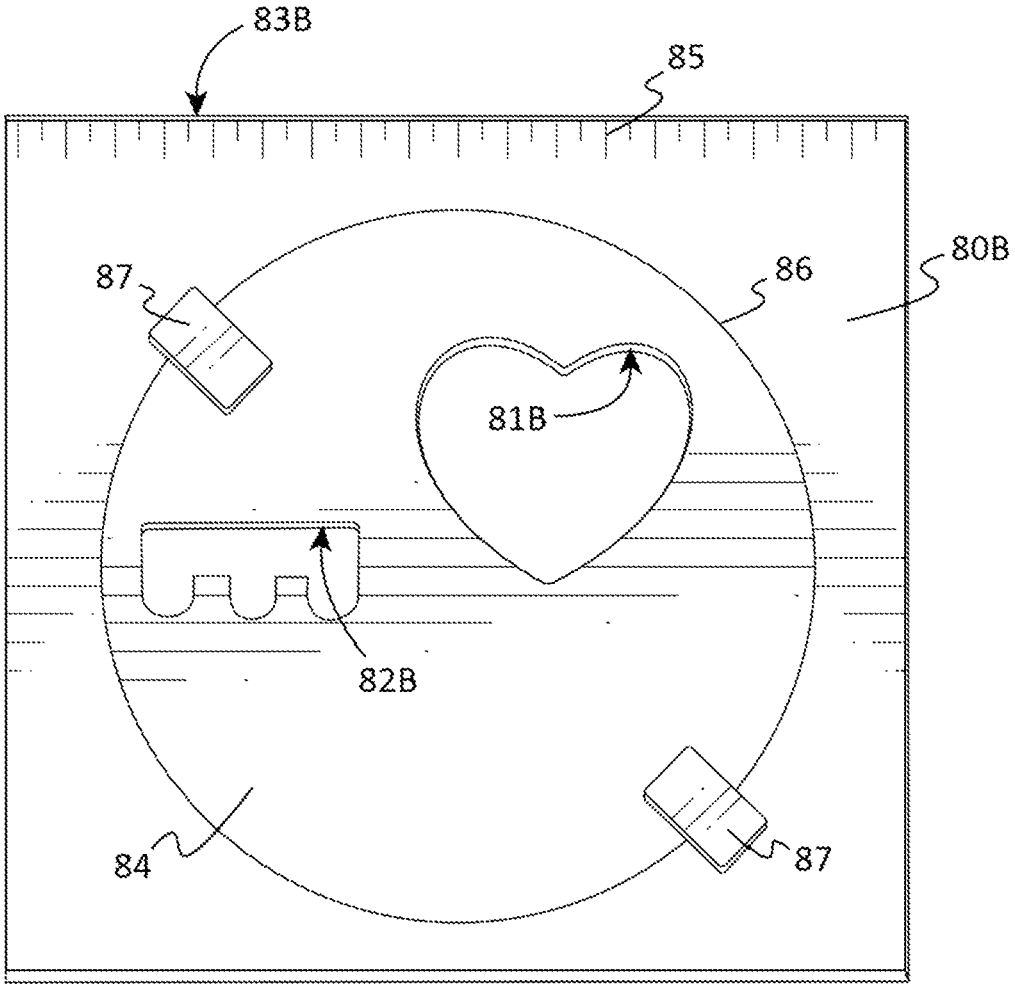
FIG. 9A shows a perspective view of an example of a template having a rotating plate according to various embodiments described herein.
Figure 9B:
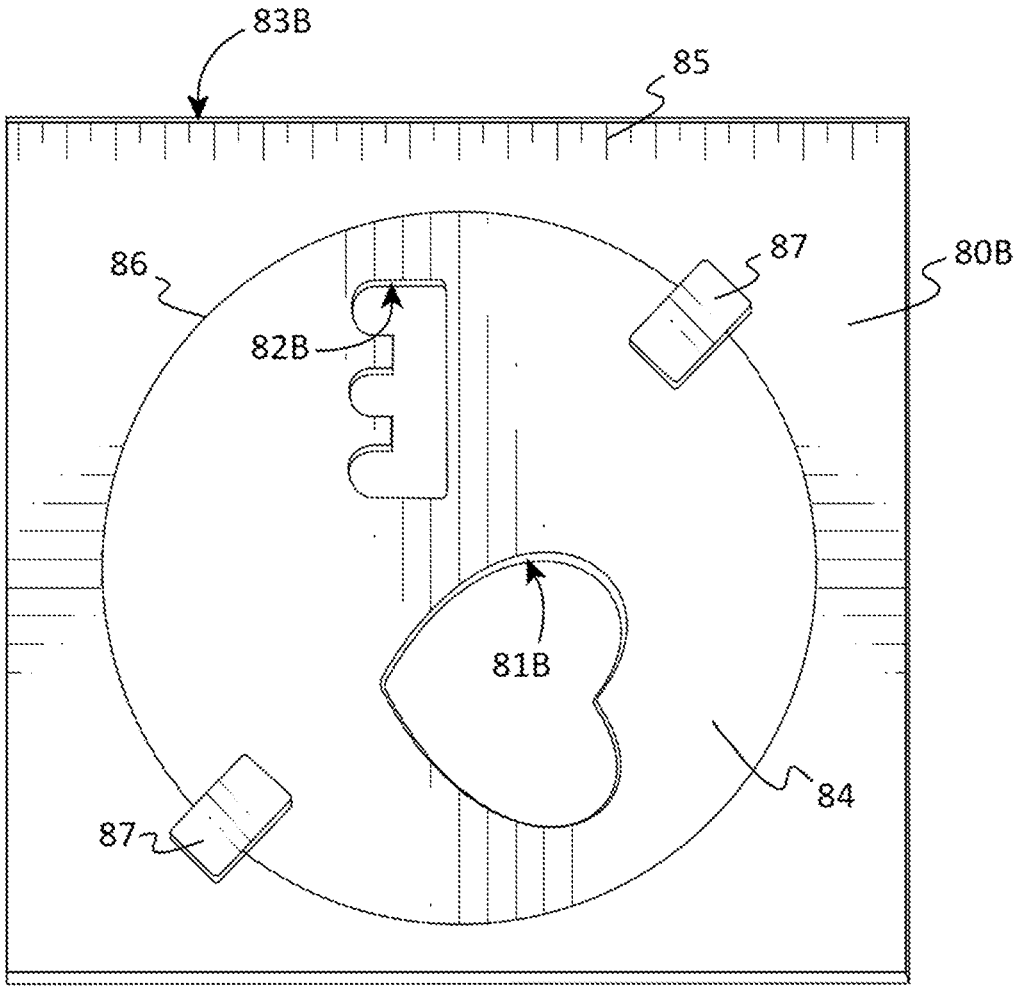
FIG. 9B depicts a perspective view of the example template of FIG. 9A in which the rotating plate has been rotated approximately ninety degrees relative to its position in FIG. 9A according to various embodiments described herein.

Referring to FIGS. 9A and 9B, another example of a template 80B having a first guide surface 81B and a second guide surface 82B which may be shaped differently than each other is illustrated. In this example, the first guide surface 81B comprises a heart shape and the second guide surface 82B comprises a compound shape having a number of straight sides and curved sides. In this manner, when a user 500 moves a sewing machine foot 401 across or along the first guide surface 81B the sewing machine 400 may produce stitching with a heart pattern or shape while a different pattern or shape that is not a heart pattern or shape may be produced by moving the sewing machine foot 401 across or along the second guide surface 82B. For example, by placing the sewing machine foot 401 in contact with the second guide surface 82B and by rotating a rotating plate 84 that the second guide surface 82B is formed into, stitching in a series of three concentric circles or arcs may be produced. Optionally, a guide surface, such as a third guide surface 83B in this example, may comprise indexing indicia 85 which are indicators of distance which may be used by the user 500 to guide a sewing machine foot 401 a desired distance across or along the third guide surface 83B and/or guide placement of the template 80B on a workpiece 300.

In some embodiments, a template 80B may comprise a rotating plate 84, which may be movably coupled to other portions of the template 80B, and one or more guide surfaces 81B, 82B, may be formed in portions of the rotating plate 84 as shown in FIGS. 9A and 9B. Preferably, a rotating plate 84 may be generally circular in shape and may be positioned in a slightly larger circular shaped template aperture 86 so that the rotating plate 84 may be pivoted or rotated within the template aperture 86. Optionally, a captivating plate 87 may be coupled to the rotating plate 84 which may comprise one or more portions that may extend across the template aperture 86. Similar to the function of a stop plate 66 in preventing a male protrusion 64 from falling through a female indention 65, a captivating plate 87 may prevent a rotating plate 84 from falling through a template aperture 86 while allowing the rotating plate 84 to be rotated and positioned in and out of the template aperture 86 from above a workpiece 300 that the template 80B is being supported over by the device 10.

In some embodiments, the device 10 may comprise one or more templates 80 which may be removably coupled to a guide 31. In preferred embodiments, a template 80 may be removably coupled to a guide 31 by being tensioned between a top 32 and bottom 34 brace of the guide 31. For example, a guide 31 may include a tensioner 36 that may comprise threading 37 which may be used to threadedly engage a bottom brace 34 and top brace 32 together while portions of a template 80 are positioned between the braces 32, 34. By turning the tensioner 36 in a first direction the bottom brace 34 and top brace 32 may be increasingly tensioned together thereby tensioning and coupling the template 80 and braces 32, 34, together. By turning the tensioner 36 in a second direction the tension between the bottom brace 34 and the top brace 32 may be decreased so as to allow the bottom brace 34 and the top brace 32 to be increasingly separated from each other and to allow the template 80 to be uncoupled from the braces 32, 34. In other embodiments, any other suitable coupling method may be used to removably couple a guide 31 and template 80 together.

In some embodiments, the device 10 may comprise one or more tensioner channels 38 which may be formed into a frame base 11, first extension 12, second extension 15, and/or frame top 21 and which may be configured to allow portions of a tensioner 36 to be inserted through the tensioner channels 38. Tensioner channels 38 may be configured in any size and shape. In some embodiments, portions of a tensioner channel 38 in contact with and proximate to an extension lower surface 56, 58, may be wider than opposing portions of the tensioner channel 38 in contact with and proximate to an extension upper surface 55, 57, and the wider portions may allow portions of a tensioner 36 to be received in and/or countersunk below the extension lower surface 56, 58. For example, a tensioner 36 may comprise a flat head bolt or screw, round head bolt or screw, button head bolt or screw, hex head bolt or screw, etc. which may form threading 37 of the tensioner 36, and the wider portions of the tensioner channel 38 may receive the head to allow the head to be positioned flush with or below the extension lower surface 56, 58, so that all of the head may be received in the tensioner channel 38 while not allowing the head to pass through the tensioner channel 38. As another example, a tensioner 36 may comprise a countersunk head bolt or screw (typically having a v-shaped head in profile) which may form threading 37 of the tensioner 36, and the wider portions of the tensioner channel 38 may be generally v-shaped in profile tapering towards the narrower portions of the tensioner channel 38 which may allow the head to be flush with or below the extension lower surface 56, 58, so that all of the head may be received in the tensioner channel 38 while not allowing the head to pass through the tensioner channel 38.

In preferred embodiments, a tensioner channel 38 may comprise an elongated shape so that once portions of a tensioner 36 are inserted through the tensioner channel 38 the tensioner 36 may be moved a distance along the frame base 11, first extension 12, second extension 15, and/or frame top 21 that it is formed in. For example, a first extension 12 may comprise a first tensioner channel 38 that may be elongated and which may extend generally parallel with a second elongated tensioner channel 38 that may be formed in a second extension 15. A guide 31 may comprise two tensioners 36 and each tensioner 36 may be received in a tensioner channel 38 so that the guide 31 may be moved towards and away from the frame base 11 and frame top 21 while the tensioners 36 are received in their respective tensioner channel 38. In other embodiments, a tensioner channel 38 may comprise a generally circular shape that may be slightly larger than the portions of the tensioner 36 that may be received in it so that movement of the tensioner 36 relative to the frame base 11, first extension 12, second extension 15, and/or frame top 21 that it is formed in may be limited or substantially prevented.

Preferably, a template 80 (with the suffixes of "A" and "B" designating different embodiments of the template 80, so that the templates 80A and 80B read on the teachings of template 80), rotating plate 84, and captivating plate 87 may be generally flat planar in shape, such as by being formed of ¼ inch thick Polycarbonate and Acrylic plastic sheet material that is preferably clear or transparent material. However, a template 80, rotating plate 84, and captivating plate 87 may be made from or may comprise any substantially rigid material, such as other plastics, aluminum or other metals, etc.

While some exemplary shapes and sizes have been provided for elements of the device 10, it should be understood to one of ordinary skill in the art that the frame base 11, first extension 12, second extension 15, frame top 21, guide 31, template 80, and any other element described herein may be configured in a plurality of sizes and shapes including "T" shaped, "X" shaped, square shaped, rectangular shaped, cylinder shaped, cuboid shaped, hexagonal prism shaped, triangular prism shaped, or any other geometric or non-geometric shape, including combinations of shapes. It is not intended herein to mention all the possible alternatives, equivalent forms or ramifications of the invention. It is understood that the terms and proposed shapes used herein are merely descriptive, rather than limiting, and that various changes, such as to size and shape, may be made without departing from the spirit or scope of the invention.

Additionally, while some materials have been provided, in other embodiments, the elements that comprise the device 10 may be made from or may comprise durable materials such as aluminum, steel, other metals and metal alloys, wood, hard rubbers, hard plastics, fiber reinforced plastics, carbon fiber, fiberglass, resins, polymers or any other suitable materials including combinations of materials. Additionally, one or more elements may be made from or may comprise durable and slightly flexible materials such as soft plastics, silicone, soft rubbers, or any other suitable materials including combinations of materials. In some embodiments, one or more of the elements that comprise the device 10 may be coupled or connected together with heat bonding, chemical bonding, adhesives, clasp type fasteners, clip type fasteners, rivet type fasteners, threaded type fasteners, other types of fasteners, or any other suitable joining method. In other embodiments, one or more of the elements that comprise the device 10 may be coupled or removably connected by being press fit or snap fit together, by one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, a slide-to-lock type connection method or any other suitable temporary connection method as one reasonably skilled in the art could envision to serve the same function. In further embodiments, one or more of the elements that comprise the device 10 may be coupled by being one of connected to and integrally formed with another element of the device 10.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A sewing template system for use with a workpiece support frame that is configured to support a workpiece on a first support rail and a second support rail so that a sewing machine, having a sewing machine foot, is able to sew a portion of the workpiece positioned between the first support rail and second support rail, the system comprising:

a frame base configured to rest on the first support rail;

a first extension having a first proximal end and a first distal end, the first proximal end coupled to the frame base and the first distal end extending away from the frame base;

a second extension having a second proximal end and a second distal end, the second proximal end coupled to the frame base and the second distal end extending away from the frame base, wherein the first extension and second extension are parallel to each other, and wherein the first extension and second extension are coupled to the frame base so that the first extension and second extension are separated from each other;

a first rail retainer coupled to the first distal end and configured to rest on the second support rail;

a second rail retainer coupled to the second distal end and configured to rest on the second support rail;

a frame top having a first end and a second end, wherein the first end is configured to be coupled to the first distal end, wherein the second end is configured to be coupled to the second distal end;

a frame aperture formed by the frame base, first extension, second extension, and frame top when the first end is coupled to the first distal end and the second end is coupled to the second distal end; and a guide that extends across the frame aperture between the first extension and the second extension, wherein the guide is supported above the workpiece by the first extension and the second extension.

2. The system of claim 1, wherein the first rail retainer comprises a first retainer surface having a concave shape, and wherein the second rail retainer comprises a second retainer surface having a concave shape.

3. The system of claim 1, wherein the frame top is removably coupled to at least one of the first distal end and the second distal end.

4. The system of claim 1, wherein the first end of the frame top comprises a male protrusion and the first distal end comprises a female indention that is complementary in shape to the male protrusion, and wherein the male protrusion is received in the female indention when the first end is coupled to the first distal end.

5. The system of claim 4, wherein the system comprises an x-axis, a y-axis, and a z-axis, wherein the male protrusion is prevented from moving in the x-axis and y-axis when it is received in the female indention, and wherein the male protrusion is released from the female indention by moving the male protrusion in the z-axis.

6. The system of claim 1, wherein the guide comprises a non-slip pad that increases the coefficient of friction between the guide and an extension selected from the first extension and the second extension.

7. The system of claim 1, wherein the guide comprises a top brace, and wherein the top brace configured to extend across the frame aperture and rest on both the first extension and the second extension so that the guide is supported by the first extension and the second extension.

8. The system of claim 1, wherein the guide comprises a bottom brace and a tensioner that is configured to tension the bottom brace towards the top brace.

9. The system of claim 8, further comprising a template that is removably coupled to the guide, the template having a first guide surface that is configured to guide the movement of a sewing machine foot when the sewing machine foot is moved along the first guide surface, and wherein the template is coupled to the guide by being tensioned between the top and bottom braces.

10. The system of claim 9, wherein the template comprises a rotating plate, and wherein the first guide surface is formed in portions of the rotating plate.

11. The system of claim 10, wherein the template comprises a second guide surface that is configured to guide the movement of the sewing machine foot when the sewing machine foot is moved along the second guide surface, and wherein the second guide surface is shaped differently than the first guide surface.

12. A sewing template device for use with a workpiece support frame that is configured to support a workpiece on a first support rail and a second support rail so that a sewing machine, having a sewing machine foot, is able to sew a portion of the workpiece positioned between the first support rail and second support rail, the device comprising:

a frame base configured to rest on the first support rail;

a first extension having a first proximal end and a first distal end, the first proximal end coupled to the frame base and the first distal end extending away from the frame base;

a second extension having a second proximal end and a second distal end, the second proximal end coupled to the frame base and the second distal end extending away from the frame base, wherein the first extension and second extension are parallel to each other, and wherein the first extension and second extension are coupled to the frame base so that the first extension and second extension are separated from each other;

a first rail retainer coupled to the first distal end and configured to rest on the second support rail;

a second rail retainer coupled to the second distal end and configured to rest on the second support rail;

a frame top having a first end and a second end, wherein the first end is configured to be coupled to the first distal end, wherein the second end is configured to be coupled to the second distal end;

a frame aperture formed by the frame base, first extension, second extension, and frame top when the first end is coupled to the first distal end and the second end is coupled to the second distal end; and a guide that extends across the frame aperture between the first extension and the second extension, wherein the guide is supported above the workpiece by the first extension and the second extension a template that is removably coupled to the guide, the template having a first guide surface that is configured to guide the movement of a sewing machine foot when the sewing machine foot is moved along the first guide surface, wherein the template comprises a rotating plate, and wherein the first guide surface is formed in portions of the rotating plate.

13. The device of claim 12, wherein the first rail retainer comprises a first retainer surface having a concave shape, and wherein the second rail retainer comprises a second retainer surface having a concave shape.

14. The device of claim 12, wherein the frame top is removably coupled to at least one of the first distal end and the second distal end.

15. The device of claim 12, wherein the first end of the frame top comprises a male protrusion and the first distal end comprises a female indention that is complementary in shape to the male protrusion, and wherein the male protrusion is received in the female indention when the first end is coupled to the first distal end.

16. The device of claim 15, wherein the system comprises an x-axis, a y-axis, and a z-axis, wherein the male protrusion is prevented from moving in the x-axis and y-axis when it is received in the female indention, and wherein the male protrusion is released from the female indention by moving the male protrusion in the z-axis.

17. The device of claim 12, wherein the guide comprises a non-slip pad that increases the coefficient of friction between the guide and an extension selected from the first extension and the second extension.

18. The device of claim 12, wherein the guide comprises a top brace, and wherein the top brace configured to extend across the frame aperture and rest on both the first extension and the second extension so that the guide is supported by the first extension and the second extension.

19. The device of claim 12, wherein the guide comprises a bottom brace and a tensioner that is configured to tension the bottom brace towards the top brace, and wherein the template is coupled to the guide by being tensioned between the top and bottom braces.

20. The device of claim 19, wherein the template comprises a second guide surface that is configured to guide the movement of the sewing machine foot when the sewing machine foot is moved along the second guide surface, and wherein the second guide surface is shaped differently than the first guide surface.

* * * * *